US007414369B2

(12) United States Patent
Sutardja

(10) Patent No.: US 7,414,369 B2
(45) Date of Patent: Aug. 19, 2008

(54) CONTROL SYSTEM FOR FLUORESCENT LIGHT FIXTURE

(75) Inventor: Sehat Sutardja, Los Altos Hills, CA (US)

(73) Assignee: Marvell World Trade Ltd., St. Michael (BB)

( * ) Notice: Subject to any disclaimer, the term of this patent is extended or adjusted under 35 U.S.C. 154(b) by 0 days.

(21) Appl. No.: 11/190,025

(22) Filed: Jul. 26, 2005

(65) Prior Publication Data

US 2006/0232213 A1 Oct. 19, 2006

Related U.S. Application Data

(63) Continuation-in-part of application No. 11/112,808, filed on Apr. 22, 2005.

(60) Provisional application No. 60/672,250, filed on Apr. 18, 2005.

(51) Int. Cl.
*H01J 7/44* (2006.01)

(52) U.S. Cl. ..... 315/46; 315/46; 315/291

(58) Field of Classification Search ..... 315/46, 315/47, 291, 209 R, 307, 308, 49
See application file for complete search history.

(56) References Cited

U.S. PATENT DOCUMENTS

| | | | | |
|---|---|---|---|---|
| 3,587,061 | A * | 6/1971 | Bieszczad et al. | 365/106 |
| 3,978,368 | A | 8/1976 | Tomura et al. | 315/101 |
| 5,309,066 | A | 5/1994 | Ditlevsen | 315/205 |
| 5,402,303 | A | 3/1995 | Luck et al. | 361/171 |
| 5,744,912 | A | 4/1998 | So | 315/127 |
| 5,798,614 | A | 8/1998 | Bishop et al. | 315/107 |
| 5,973,455 | A * | 10/1999 | Mirskiy et al. | 315/105 |
| 5,977,723 | A | 11/1999 | Yoon | 315/247 |
| 6,066,920 | A | 5/2000 | Torihara et al. | 315/50 |
| 6,081,077 | A * | 6/2000 | Canova et al. | 315/307 |
| 6,140,751 | A | 10/2000 | Hammer et al. | 313/46 |
| 6,140,772 | A | 10/2000 | Bishop | 315/106 |
| 6,222,325 | B1 * | 4/2001 | Wuidart et al. | 315/209 R |
| 6,285,138 | B1 | 9/2001 | Kataoka et al. | 315/291 |
| 6,339,299 | B1 * | 1/2002 | Wu et al. | 315/244 |
| 6,366,031 | B2 | 4/2002 | Klein | 315/291 |
| 6,424,100 | B1 * | 7/2002 | Kominami et al. | 315/307 |
| 6,453,145 | B1 | 9/2002 | Miura | 399/336 |
| 6,525,479 | B1 | 2/2003 | Keggenhoff et al. | 315/88 |

(Continued)

FOREIGN PATENT DOCUMENTS

EP 1 338 874 A 8/2003

(Continued)

OTHER PUBLICATIONS

Communication from the European Patent Office dated Sep. 12, 2006 and the extended European Search Report for Application No. 06006307.0-2206; 6 pages.

(Continued)

*Primary Examiner*—Trinh Vo Dinh
*Assistant Examiner*—Dieu Hien T Duong

(57) ABSTRACT

A control system comprises a switch and a control module that communicates with the switch and that samples a filament resistance of a fluorescent light when the switch is off and that selectively increases current supplied to the fluorescent light above a nominal current value during turn on based on the filament resistance.

51 Claims, 8 Drawing Sheets

U.S. PATENT DOCUMENTS

| | | | | |
|---|---|---|---|---|
| 6,728,088 | B2 | 4/2004 | Aiello et al. | 361/103 |
| 6,731,078 | B2 | 5/2004 | Huber et al. | 315/307 |
| 6,828,740 | B2 | 12/2004 | Takahashi et al. | 315/291 |
| 6,880,967 | B2 | 4/2005 | Isozumi et al. | 374/102 |
| 6,909,246 | B2 | 6/2005 | Hein | 315/248 |
| 6,940,733 | B2 | 9/2005 | Schie et al. | 363/15 |
| 2002/0101185 | A1 | 8/2002 | Kozlowski | 315/224 |
| 2003/0146718 | A1 | 8/2003 | Horluchi et al. | 315/291 |
| 2003/0156988 | A1* | 8/2003 | Sondergaard | 422/96 |
| 2003/0185271 | A1* | 10/2003 | Isozumi et al. | 374/45 |
| 2003/0218426 | A1* | 11/2003 | Shultz et al. | 315/86 |
| 2004/0232855 | A1 | 11/2004 | Ribarich et al. | 315/291 |
| 2006/0006814 | A1* | 1/2006 | Wendt et al. | 315/291 |

FOREIGN PATENT DOCUMENTS

| | | | |
|---|---|---|---|
| EP | 1 338 874 | A1 | 8/2003 |
| WO | WO 88/01467 | A | 2/1988 |
| WO | WO 88/01467 | A1 | 2/1988 |
| WO | WO 2005/006820 | A1 | 1/2005 |

OTHER PUBLICATIONS

Examination Report from the European Patent Office dated May 21, 2007 for Application No. 06 006 307.0-2206; 1 page.

Official Action including the Search Report and Written Opinion from the Intellectual Property Office of Singapore dated May 23, 2007 for Singapore Application No. 200601868-3; 15 pages.

Official Action including the Search Report and Written Opinion from the Intellectual Property Office of Singapore dated May 23, 2007 for Singapore Application No. 200601867-5; 15 pages.

Communication from the European Patent Office dated Oct. 6, 2006 and the extended European Search Report for Application No. 06006308.8-2206; 6 pages.

* cited by examiner

CONTROL SYSTEM FOR FLUORESCENT LIGHT FIXTURE

CROSS-REFERENCE TO RELATED APPLICATIONS

This application is a continuation-in-part of U.S. patent application Ser. No. 11/112,808 filed on Apr. 22, 2005. This application claims the benefit of U.S. Provisional Application No. 60/672,250, filed on Apr. 18, 2005. The disclosures of the above applications are incorporated herein by reference in its entirety.

FIELD OF THE INVENTION

The present invention relates to fluorescent light fixtures, and more particularly to control systems for fluorescent light fixtures.

BACKGROUND OF THE INVENTION

Referring now to FIG. 1, a fluorescent lamp 10 includes a sealed glass tube 12 that contains a first material such as mercury and a first inert gas such as argon, which are both generally identified at 14. The tube 12 is pressurized. Phosphor powder 16 may be coated along an inner surface of the tube 12. The tube 12 includes electrodes 18A and 18B (collectively electrodes 18) that are located at opposite ends of the tube 12. Power is supplied to the electrodes 18 by a control system that may include an AC source 22, a switch 24, a ballast module 26 and a capacitor 28.

When the switch 24 is closed, the control system supplies power to the electrodes 18. Electrons migrate through the gas 14 from one end of the tube 12 to the opposite end. Energy from the flowing electrons changes some of the mercury from a liquid to a gas. As electrons and charged atoms move through the tube 12, some will collide with the gaseous mercury atoms. The collisions excite the atoms and cause electrons to move to a higher state. As the electrons return to a lower energy level they release photons or light. Electrons in mercury atoms release light photons in the ultraviolet wavelength range. The phosphor coating 16 absorbs the ultraviolet photons, which causes electrons in the phosphor coating 16 to jump to a higher level. When the electrons return to a lower energy level, they release photons having a wavelength corresponding to white light.

To send current through the tube 12, the fluorescent light 10 needs free electrons and ions and a difference in charge between the electrodes 18. Generally, there are few ions and free electrons in the gas 14 because atoms typically maintain a neutral charge. When the fluorescent light 10 is turned on, it needs to introduce new free electrons and ions.

The ballast module 26 outputs current through both electrodes 18 during starting. The current flow creates a charge difference between the two electrodes 18. When the fluorescent light 10 is turned on, both electrode filaments heat up very quickly. Electrons are emitted, which ionizes the gas 14 in the tube 12. Once the gas is ionized, the voltage difference between the electrodes 18 establishes an electrical arc. The flowing charged particles excite the mercury atoms, which triggers the illumination process. As more electrons and ions flow through a particular area, they bump into more atoms, which frees up electrons and creates more charged particles. Resistance decreases and current increases. The ballast module 26 regulates power both during and after startup.

Referring now to FIG. 2, some ballast modules 50 include a control module 54, one or more electrolytic capacitors 56 and other components 58. The electrolytic capacitors 56 may be used to filter or smooth voltage. Electrolytic capacitors 56 and/or other system components may be sensitive to high operating temperatures. If the operating temperature exceeds a threshold for a sufficient period, the electrolytic capacitor 56 and/or other system components may be damaged and the fluorescent light 10 may become inoperable.

When some fluorescent lights have been off for a prolonged period, it can take a while before the fluorescent light provides a normal or nominal amount light output (as compared to when the fluorescent light has been on for a while). In other words, the fluorescent light output is initially dim when turned on, which can be annoying. In addition, fluorescent lights typically fail or burn out without providing any indication to a user. If the user does not have a replacement fluorescent light, the user may be without a light source until one can be found.

SUMMARY OF THE INVENTION

A control system comprises a switch and a control module that communicates with the switch and that samples a filament resistance of a fluorescent light when the switch is in a first state and that selectively increases current supplied to the fluorescent light above a nominal current value when said switch transitions to a second state based on the filament resistance.

In other features, the control module determines a steady-state filament resistance value when the switch is in said first state and monitors changes in the steady state filament resistance value. An indicator communicates with the control module. The control module compares changes in the steady state filament resistance value to a predetermined filament resistance change threshold and changes a state of the indicator when the changes in the steady state filament resistance value exceed the predetermined filament resistance change threshold. The control module compares the steady state filament resistance value to a predetermined filament resistance threshold and changes a state of the indicator when the steady state filament resistance value exceeds the predetermined filament resistance threshold.

In other features, the control module increases at least one of current and voltage to the filament by a first amount above the nominal current level when the switch transitions to said second state based on a stored filament resistance value of the filament that is stored before the switch transitions to said second state. The control module determines and stores a steady-state filament resistance value when the switch is in said first state. The control module increases at least one of current and voltage to the filament by a first amount above the nominal level when the switch transitions to said second state based on a difference between a stored filament resistance value that is stored before the switch transitions to said second state and the stored steady state filament resistance value. An ambient temperature estimator estimates ambient temperature. The changes in the steady state filament resistance value are adjusted based on the ambient temperature. The ambient temperature estimator includes a temperature sensor. The ambient temperature estimator estimates the ambient temperature based on a filament resistance measured after the fluorescent light has been in said second state for a predetermined period.

In other features, a ballast module comprises an electrolytic capacitance element. A temperature sensor senses a temperature of the electrolytic capacitance element. The control module communicates with the temperature sensor and adjusts power output to the fluorescent light when the sensed temperature exceeds a predetermined threshold. The control module modulates the power output based on the sensed temperature.

In other features, a rectifier module has an input that selectively communicates with a voltage source. The electrolytic capacitance element and the control module communicate with an output of the rectifier module.

In other features, a temperature sensor senses a temperature of a first electrical component. The control module communicates with the temperature sensor and adjusts power output to the fluorescent light when the sensed temperature exceeds a predetermined threshold. A rectifier module has an input that selectively communicates with a voltage source. The control module communicates with an output of the rectifier module.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
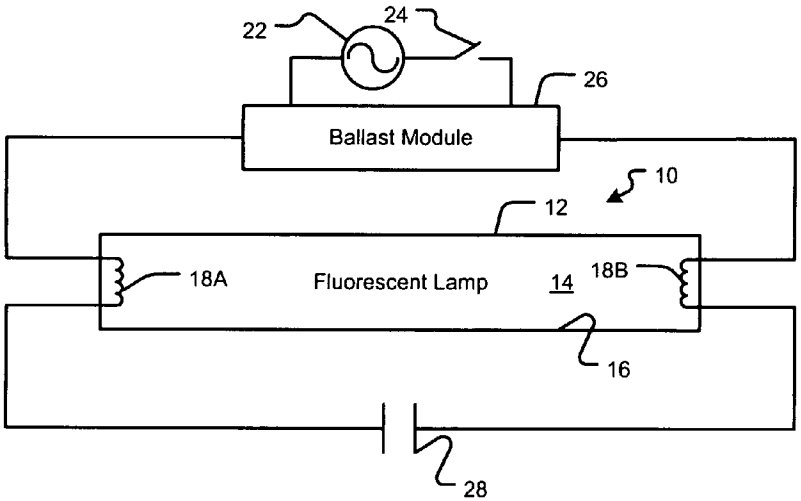
FIG. 1 Prior Art
FIG. 1 is a functional block diagram of an exemplary control system for a fluorescent light according to the prior art.
Figure 2:
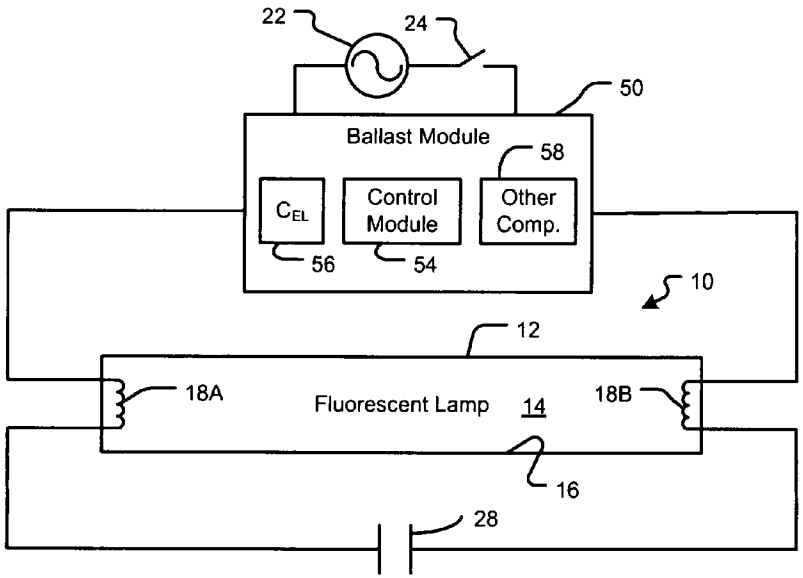
FIG. 2 Prior Art
FIG. 2 is a more detailed functional block diagram of the control system for the fluorescent light of FIG. 1.

The following description of the preferred embodiment(s) is merely exemplary in nature and is in no way intended to limit the invention, its application, or uses. As used herein, the term module refers to an application specific integrated circuit (ASIC), an electronic circuit, a processor (shared, dedicated, or group) and memory that execute one or more software or firmware programs, a combinational logic circuit, and/or other suitable components that provide the described functionality. For purposes of clarity, the same reference numbers will be used in the drawings to identify similar elements.

Figure 3:
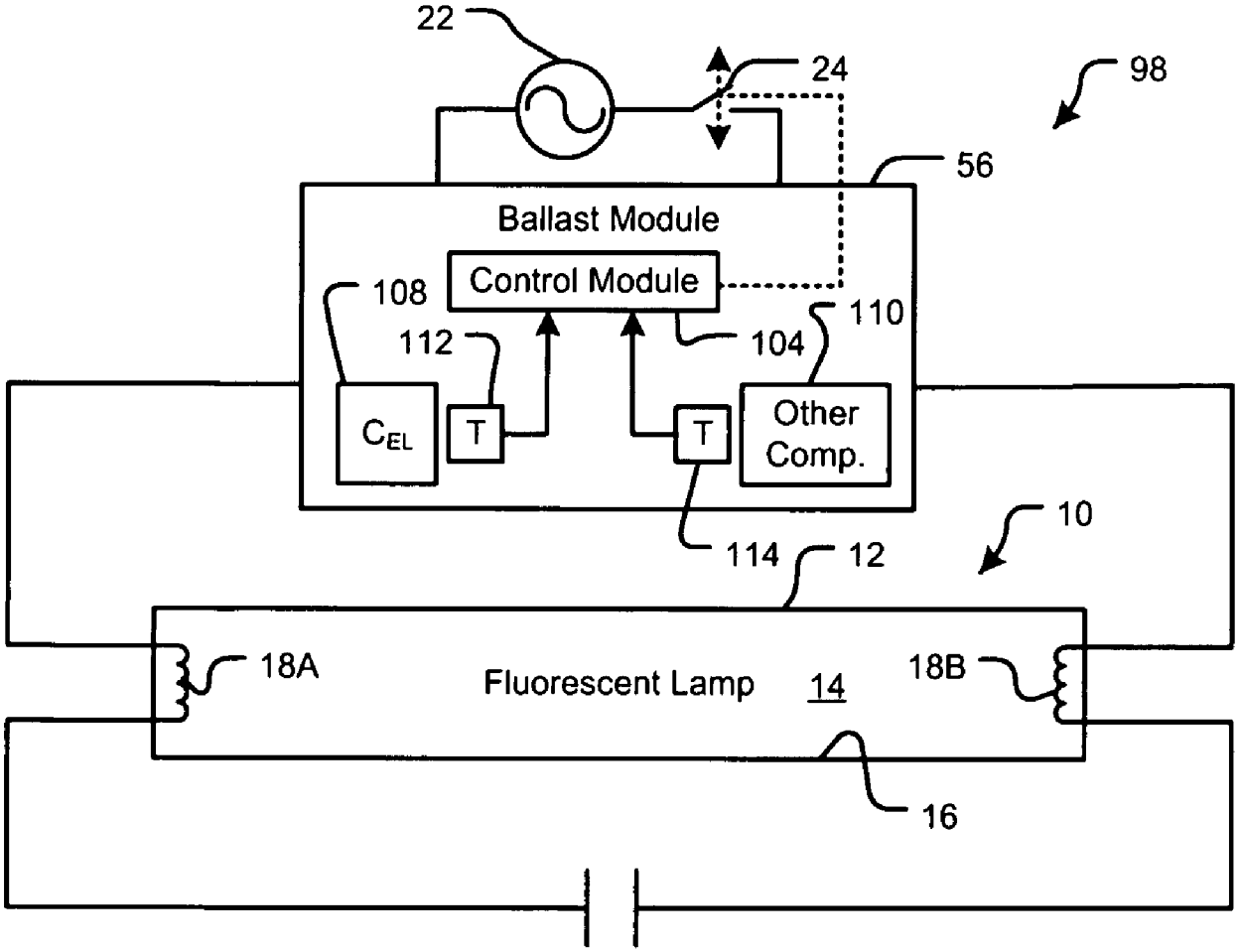
FIG. 3 is a functional block diagram of an improved control system for a fluorescent light according to the present invention.

Referring now to FIG. 3, a functional block diagram of a control system 98 for the fluorescent light 10 is shown. A ballast module 100 includes a control module 104, one or more electrolytic capacitors 108, and one or more other components generally identified at 110. The ballast module 100 includes one or more temperature sensing modules 112 and 114 that sense operating temperatures of components of the ballast module 100 and/or of the control system of the fluorescent light 10. In some implementations, the temperature sensor 112 senses an operating temperature of the electrolytic capacitor 108 and the temperature sensor 114 senses an operating temperature of one or more other components 110 of the ballast module 100 and/or the control system 98.

The control module 104 adjusts operation of the fluorescent light 10 based on one or more of the sensed operating temperatures. For example, the control module 104 shuts off the fluorescent light 10 when the operating temperature of the electrolytic capacitor 108 exceeds a predetermined temperature threshold. Alternately, the control module 104 turns off the fluorescent light 10 for a predetermined period, until reset, indefinitely and/or using other criteria. In other implementations, the control module 104 lowers an output voltage and/or current of the ballast module 100 for a predetermined period, indefinitely, until reset and/or using other criteria.

Figure 4:
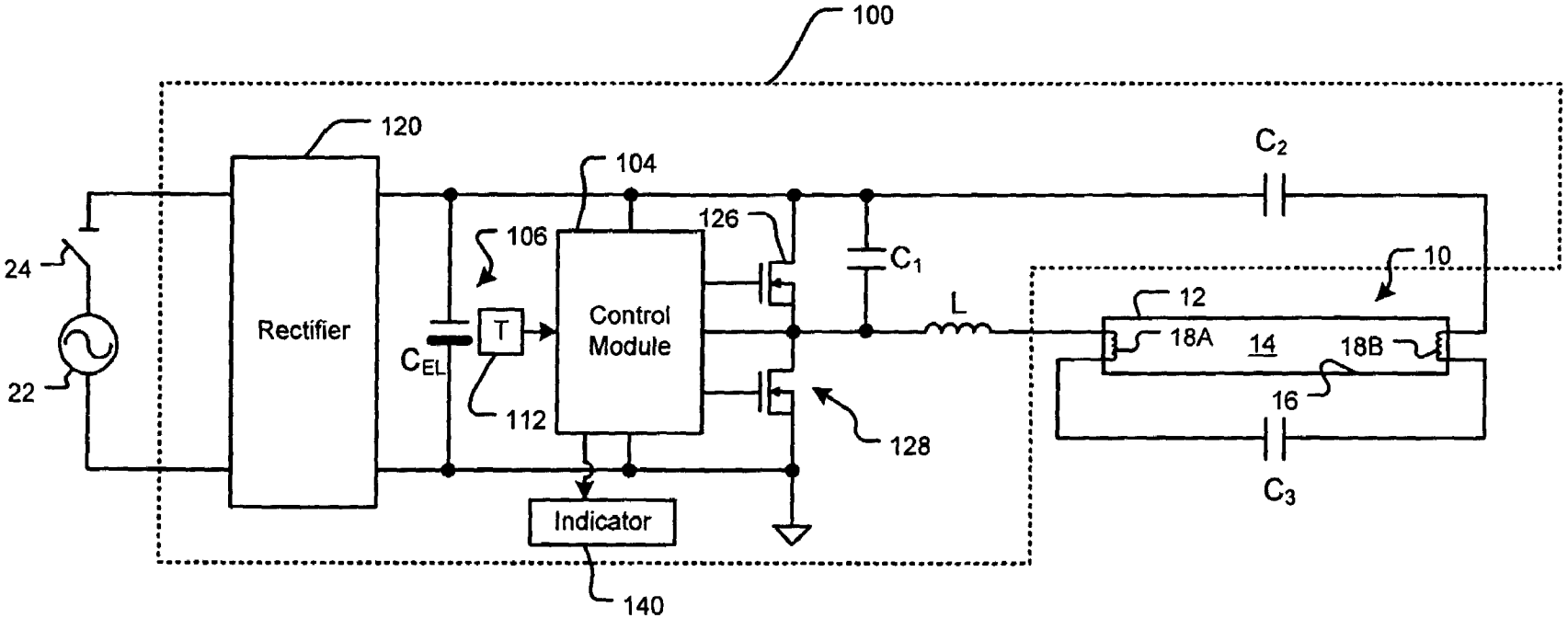
FIG. 4 is an electrical schematic and functional block diagram of an exemplary implementation of the control system of FIG. 3.

Referring now to FIG. 4, an exemplary implementation of the ballast module 100 is shown to include a full or half-wave rectifier 120, the electrolytic capacitor 108 and the control module 104. A first terminal of a power transistor 126 is connected to a first output of the rectifier 120. A second terminal is connected to the control module 104 and to a first terminal of a power transistor 128. The control module 104 switches the power transistors on and off to vary current and/or voltage to the fluorescent light 10 during startup and/or operation.

A capacitor C1 may be connected to the first output of the rectifier 120, the second terminal of the power transistor 126, the first terminal of the power transistor 128 and one end of an inductor L. An opposite end of the inductor L may communicate with one end of the electrode 18A. An opposite end of the electrode 18A is coupled by a capacitor C3 to one end of the electrode 18B. The first output of the rectifier 120 is coupled by a capacitor C2 to an opposite end of the electrode 18B. An indicator 140 communicates with the control module 104 and indicates an operational status of the fluorescent light. For example, the indicator 140 can be turned on to indicate that the fluorescent light will likely fail soon. As a result, the user can purchase or otherwise obtain a replacement fluorescent light before the installed fluorescent light fails. The indicator 140 can include a light emitting diode (LED), an incandescent light, a speaker, and/or any other visible or audio output. While the indicator is shown in FIG. 4, any of the embodiments described herein can include an indicator.

Figure 5:
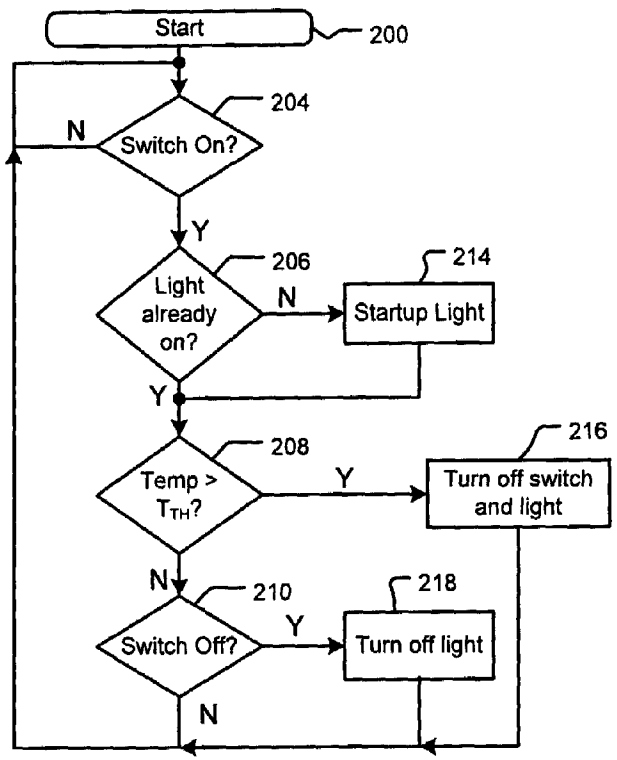
FIG. 5 is a first exemplary flowchart illustrating steps for operating the control system of FIG. 3.

Referring now to FIG. 5, a flowchart illustrating steps for operating the control system of FIG. 3 is shown. Control begins with step 200. In step 204, control determines whether the switch 24 is on. If false, control returns to step 204. If step 204 is true, control determines whether the fluorescent light 10 is already on. If true, control continues with step 208 and determines whether a sensed temperature is greater than a threshold temperature. The sensed temperature may relate to the electrolytic capacitor 56 and/or other components of the ballast module 100 and/or other components of the control system. If step 206 is false, control starts the light in step 214 continues with step 208. If step 208 is false and the threshold temperature has not been exceeded, control determines whether the switch 24 is off in step 210. If the switch 24 is not off, control returns to step 204.

When step 208 is true, control turns off the switch 24 and/or fluorescent light 10 in step 216. In some implementations, the switch 24 may be controlled by the control module 104. Alternately, the control module 104 may turn off the fluorescent light 10 independent from a position of the switch 24. Alternately, the control module 104 may operate as a three way switch in conjunction with a three-way switch 24. When step 210 is true and the switch 24 is off, control turns off the fluorescent light 10 in step 218.

Figure 6:
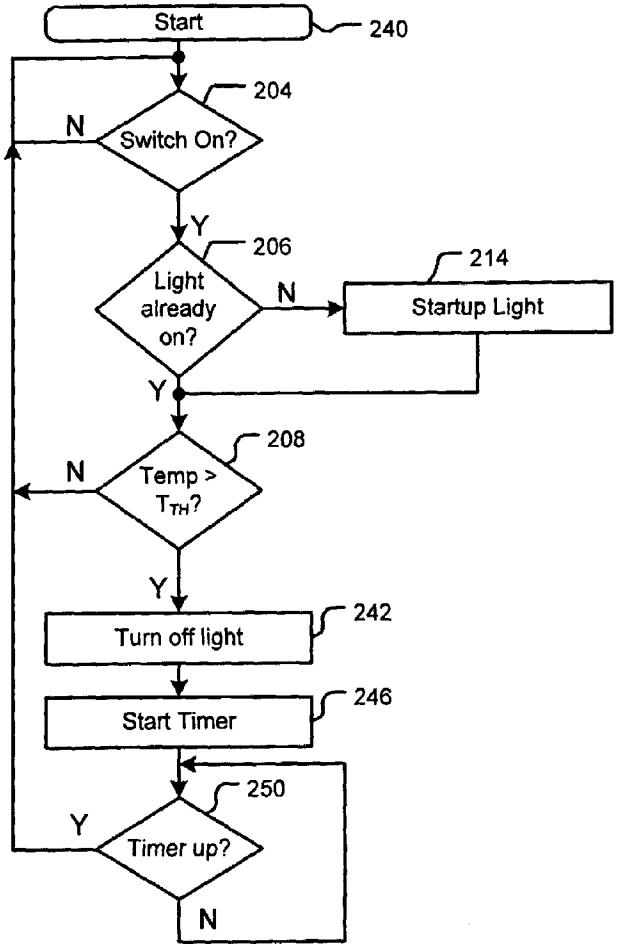
FIG. 6 is a second exemplary flowchart illustrating steps for operating the control system of FIG. 3.

Referring now to FIG. 6, a flowchart illustrating alternate steps for operating the control system of FIG. 3 is shown. When step 208 is false, control returns to step 204. When step 208 is true, control turns off the fluorescent light 10 in step 242. In step 246, control starts a timer. In step 250, control determines whether the timer is up. If step 250 is true, control returns to step 204. Otherwise, control returns to step 250.

Figure 7:
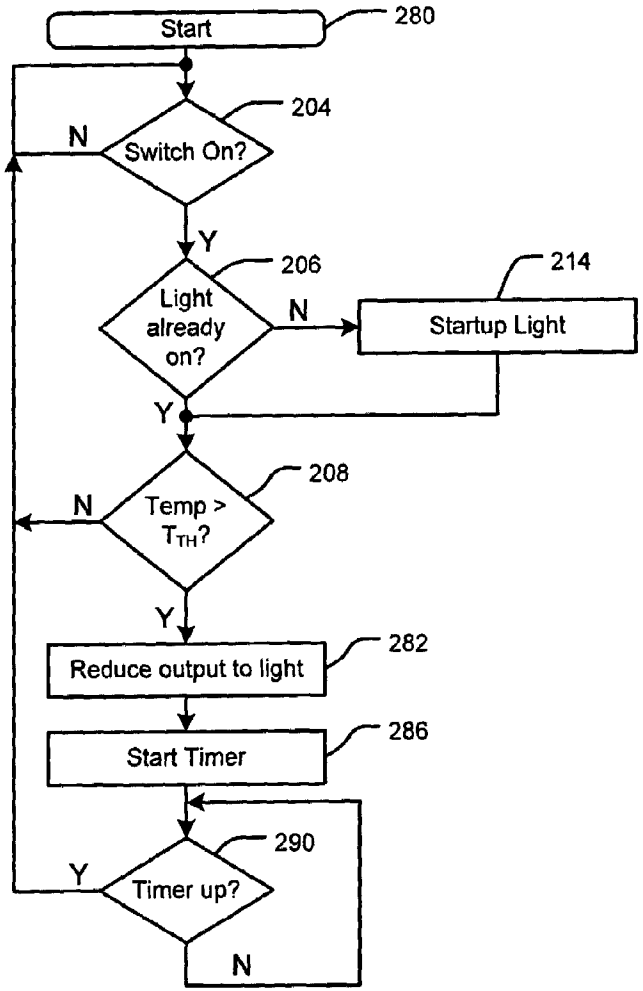
FIG. 7 is a third exemplary flowchart illustrating steps for operating the control system of FIG. 3.

Referring now to FIG. 7, a flowchart illustrating alternative steps for operating the control system of FIG. 3 is shown. When step 208 is true, control reduces power that is output to the fluorescent light 10 in step 282. Reducing power output to the fluorescent light 10 may include reducing voltage and/or current output by the ballast module 100. The fluorescent light 10 may be operated in this mode until reset using the switch 24. Alternately in step 286, control starts a timer. In step 290, control determines whether the timer is up. If step 290 is true, control returns to step 204. Otherwise, control returns to step 290.

Figure 8A:
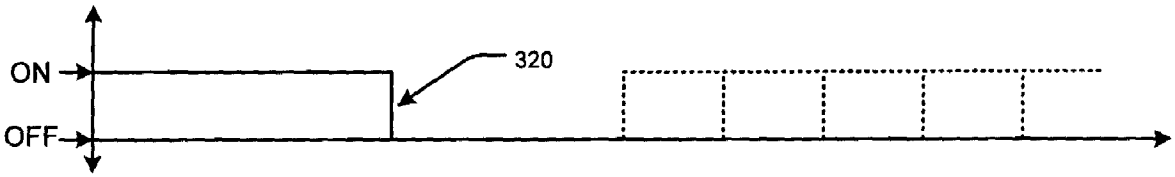
FIG. 8A is a timing diagram illustrating on time and off time of the fluorescent light.

Referring now to FIG. 8A, a timing diagram illustrates on time and off time of the fluorescent light. The fluorescent light is shown in on and off states. Depending upon how long the fluorescent light is in an off-state determines the amount of additional heat that must be added to the filament during startup. In other words, the amount of heat or power output to the filament is temporarily increased above a nominal level to reduce the amount of time that the light output is less than the nominal light output. By increasing the amount of power to the filament, the filament will heat up more rapidly and the resistance of the filament will decrease more quickly to a nominal resistance value. If the fluorescent light is off for a short duration, the amount of heat or power above the nominal level is less the amount of heat or power (above the nominal level) that is required when the fluorescent light is off for longer durations.

By measuring the resistance of the filament during the off state, the amount of heat that should be added to the filament during startup can be estimated. The resistance of the filament is sampled continuously and/or at spaced intervals when the light is turned off. As the amount of time increases after turn off, the resistance of the filament increases. During a prolonged off-state, the resistance of the filament will tend to reach a steady-state resistance value that depends upon ambient temperature and the age of the fluorescent light. The ambient temperature, in some implementations, is recorded after a prolonged off-state and stored in memory. The ambient temperature can be measured using the temperature sensors disclosed above. Alternatively, the ambient temperature can be estimated from the resistance of the filament after prolonged off time. In addition, one or more prior steady-state values of the resistance are measured and stored. A resistance limit value may also be stored.

When the resistance value reaches a steady state resistance value after turn-off, the new steady state resistance value can be compared to one or more stored steady state resistance values. A difference or change in the steady state value can be calculated. In some implementations, the stored steady state resistance value can be an average or weighted average of two or more prior steady state resistance values. Other functions can be used such as natural log functions to determine the rate of change in the resistance of the filament. If the rate of change exceeds a predetermined rate of change value and/or a predetermined resistance limit, the control module may indicate that the fluorescent light will fail soon and turn on the indicator 140.

Figure 8B:
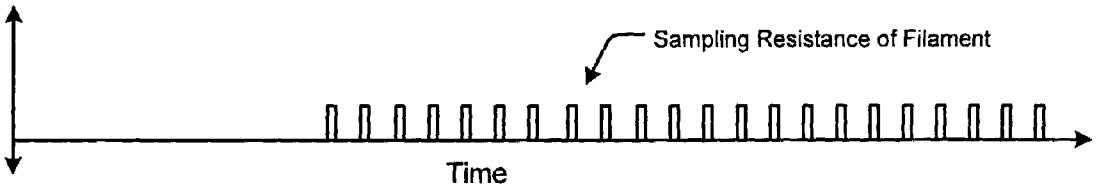
FIG. 8B is a timing diagram showing sampling of the resistance of a filament of the fluorescent light.

Referring now to FIG. 8B, a timing diagram showing sampling of the resistance of the filament is shown. When the sampling enable signal is high, the resistance of the filament is sampled. While the sampling intervals are shown as being spaced at predetermined intervals, the spacing can be varied. For example, the interval can be decreased when the resistance value is changing quickly and increased when the resistance value is changing less quickly or vice versa. Still other variations will be readily apparent. In some implementations, the resistance of the filament is measured after the fluorescent light transitions from an on state to an off state. The sampling of the resistance of the filament can be terminated when the resistance value reaches a steady state value, when the light is turned on, and/or using any other criteria.

Figure 8C:
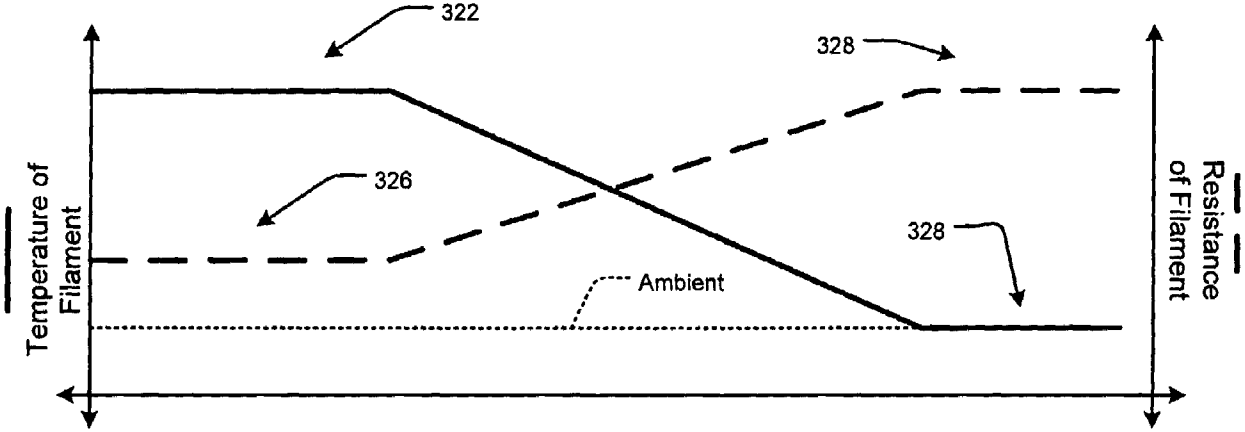
FIG. 8C showing temperature and resistance of the filament as a function of time.

Referring now to FIG. 8C, the temperature and resistance of the filament are shown as a function of time. The temperature of the filament is shown as a function of the on and off state. The graphs shown in FIG. 8C relate to a fluorescent light that has transitioned from on to off at time 320 in FIG. 8A and remains in the off state. The temperature of the filament will decrease from a nominal on temperature value at 322 to an ambient temperature value at 324. The resistance of the filament will increase as it cools from a nominal on value at 326 to a nominal off value at 328. As can be appreciated, as the fluorescent light ages, the values of the nominal on and off temperatures and resistance will vary.

Figure 9:
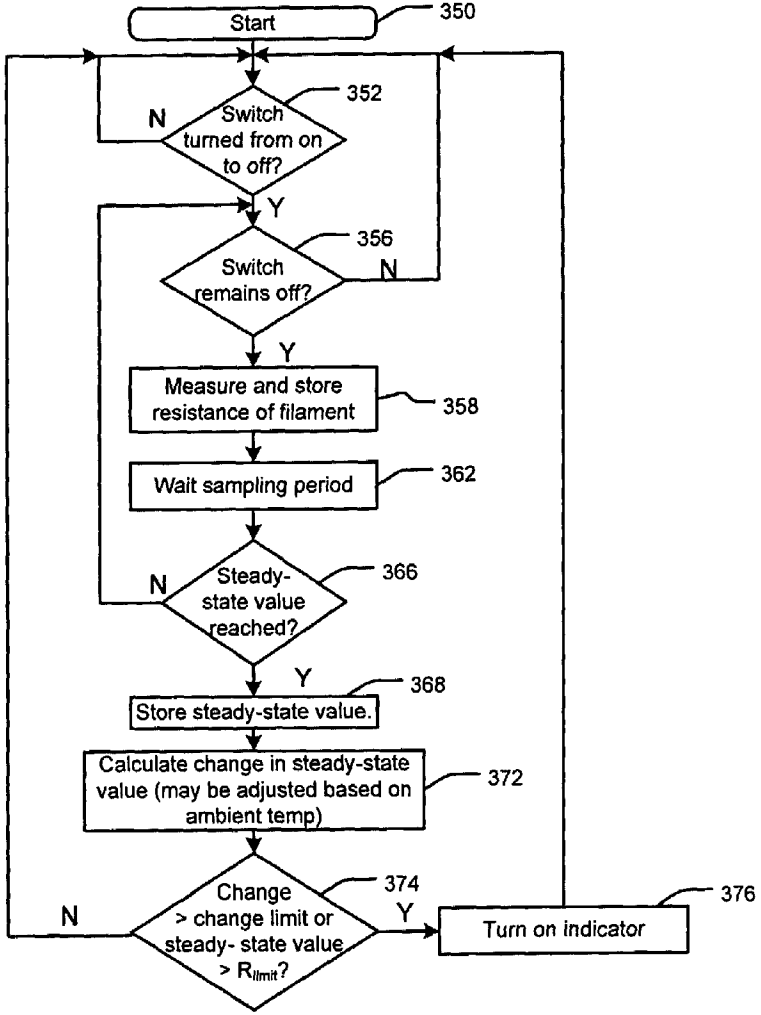
FIG. 9 is a flowchart illustrating steps of a method for sampling the resistance of the filament and identifying changes in resistance indicative of failure.

Referring now to FIG. 9, a flowchart illustrating steps of a method for sampling filament resistance and identifying changes in filament resistance indicative of impending failure are shown. Control begins with step 350. In step 352, control determines whether the switch transitions from on to off. If false, control returns to step 352. If step 352 is true, control determines whether the switch remains off in step 356. If not, control returns to step 352. If step 356 is true, control measures and stores the resistance of the filament in step 358. In step 362, control waits a sampling period that can be variable, adaptive, and/or fixed. In step 366, control determines whether a steady state resistance value has been reached. The steady state value determination can be based upon any suitable criteria. For example, in one implementation the steady state value determination can be made when the resistance value of N consecutive samples stay within a predetermined difference of one another. Still other methods for identifying the steady state value can be used.

When step 366 is true, control continues with step 368 and stores the steady state resistance value. In some implementations, the steady state resistance value may be adjusted based upon ambient temperature. In step 372, control calculates a change in the steady state value. The change is determined based on the current steady-state value and one or more prior steady state values. In step 374, control determines whether the change in the steady-state resistance is greater than a resistance change limit or whether the steady state value is greater than a resistance limit. If step 374 is true, control changes the state of the inductor, for example by turning on an indicator in step 376. If step 374 is false, control returns to step 352.

Figure 10:
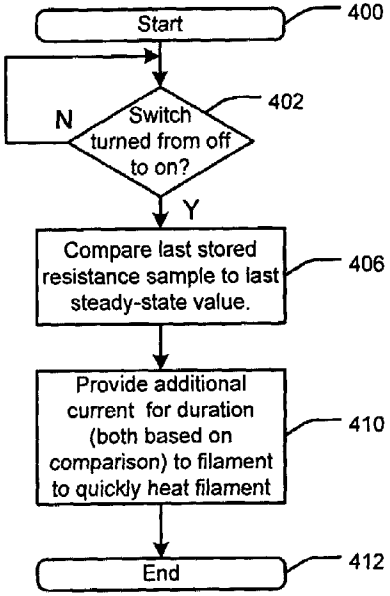
FIG. 10 is a flowchart illustrating steps of a method for adjusting current supplied during turn on to decrease the amount of time required to warm up and provide nominal light output.

Referring now to FIG. 10, a flowchart illustrating steps of a method for adjusting power during turn on to decrease the amount of time required to heat up the filament is shown. Control begins with step 400. In step 402, control determines whether the switch is turned from an off state to an on state. If step 402 is false, control returns to step 402. If step 402 is true, control compares the last stored resistance value (which may or may not be a steady state value) to one or more preceding steady-state resistance values in step 406. Assuming that the fluorescent lamp will be operating in generally constant ambient temperatures, the difference between these values is a measure of whether or not the fluorescent light has completely cooled and how much heat is required to quickly warm the filament. In step 410, the control module provides additional current for a predetermined duration to the filament to quickly heat the filament. At least one of the current level and/or the duration is based upon the comparison made in step 406. In step 412, control ends.

Figure 11:
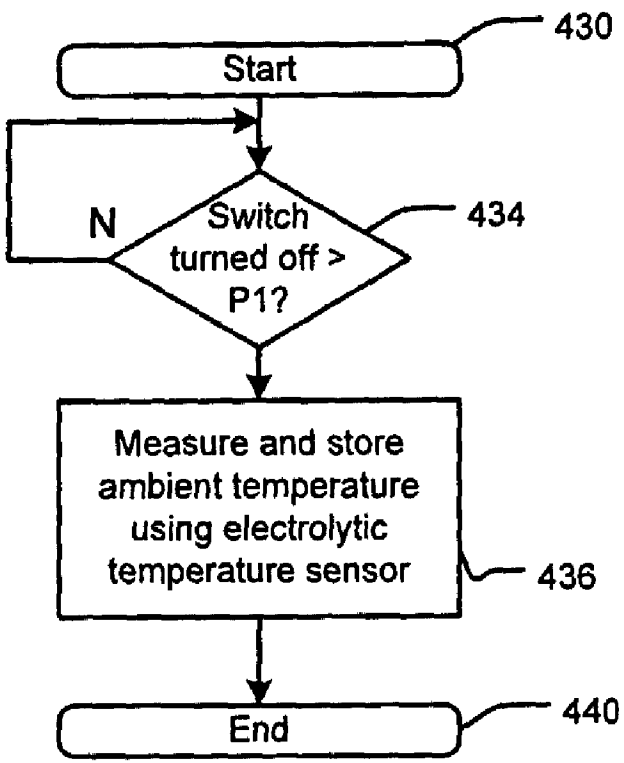
FIG. 11 is a flowchart illustrating steps of an exemplary method for determining ambient temperature.

Referring now to FIG. 11, a flowchart illustrating steps of a method for determining ambient temperature is shown. Control begins with step 430. In step 434, control determines whether the switch has been turned off for a predetermined period. The predetermined period is selected to ensure that the electrolytic capacitor and/or other components are at ambient temperature. In step 436, control measures and stores the ambient temperature using one or both of the temperature sensors described above. The ambient temperature is stored in the control module and used in the preceding methods. Control ends in step 40.

Figure 12:
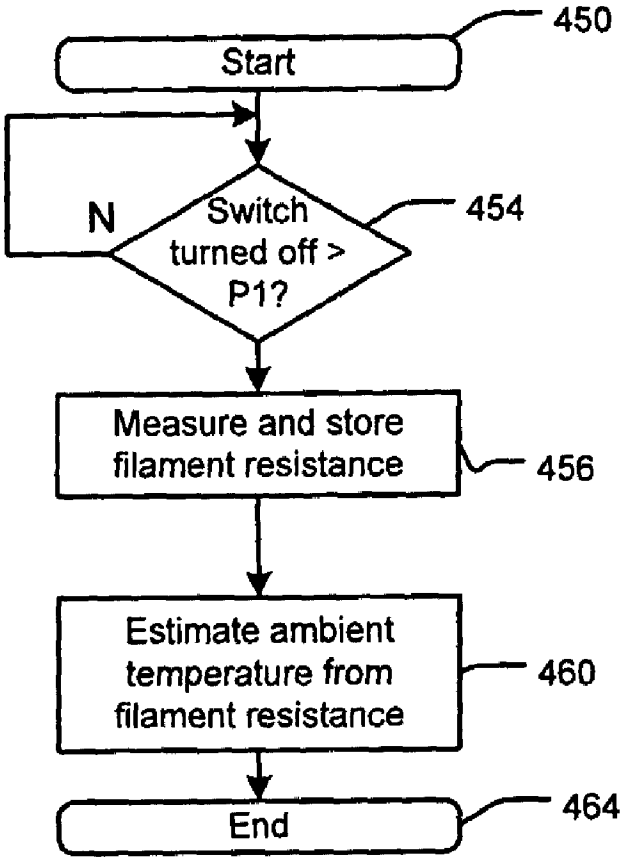
FIG. 12 is a flowchart illustrating steps of an alternative exemplary method for determining ambient temperature.

Referring now to FIG. 12, a flowchart illustrating steps of an alternate method for determining ambient temperature is shown. Control begins with step 450. In step 454, control determines whether the switch has been turned off for a predetermined period. In step 456, control measures and stores the filament resistance. In step 460, the ambient temperature is estimated based on the filament resistance. The ambient temperature is stored in the control module and used in the preceding methods. Control ends in step 464.

Those skilled in the art can now appreciate from the foregoing description that the broad teachings of the present invention can be implemented in a variety of forms. For example, the temperature of a component can be sensed and the current output can be modulated accordingly. Hysteresis, averaging and/or other techniques can be used to reduce flicker and/or other noticeable changes in light intensity that may occur. Therefore, while this invention has been described in connection with particular examples thereof, the true scope of the invention should not be so limited since other modifications will become apparent to the skilled practitioner upon a study of the drawings, the specification and the following claims.

What is claimed is:

1. A control system comprising:

a switch that switches power to a filament of a fluorescent light and that has first and second states, said second state associated with supplying power to said filament and said first state associated with removing power from said filament; and a control module that communicates with said switch and that samples a filament resistance of said filament when said switch is in said first state and that selectively increases current supplied to the fluorescent light above a nominal current value when said switch transitions to said second state based on said filament resistance.

2. The control system of claim 1 wherein said control module determines a steady-state filament resistance value when said switch is in said first state and monitors changes in said steady state filament resistance value.

3. The control system of claim 2 further comprising an indicator that communicates with said control module and that indicates an operational state of said fluorescent light.

4. The control system of claim 3 wherein said control module compares changes in said steady state filament resistance value to a predetermined filament resistance change threshold and changes a state of said indicator when said changes in said steady state filament resistance value exceed said predetermined filament resistance change threshold.

5. The control system of claim 4 further comprising an ambient temperature estimator that estimates ambient temperature.

6. The control system of claim 5 wherein said changes in said steady state filament resistance value are adjusted based on said ambient temperature.

7. The control system of claim 5 wherein said ambient temperature estimator includes a temperature sensor.

8. The control system of claim 5 wherein said ambient temperature estimator estimates said ambient temperature based on a filament resistance measured after said fluorescent light has been in said first state for a predetermined period.

9. The control system of claim 3 wherein said control module compares said steady state filament resistance value to a predetermined filament resistance threshold and changes a state of said indicator when said steady state filament resistance value exceeds said predetermined filament resistance threshold.

10. The control system of claim 1 wherein said control module increases at least one of current and voltage to said filament by a first amount above said nominal current level when said switch turns on based on a stored filament resistance value of said filament that is stored before said switch turns on.

11. The control system of claim 10 wherein said control module determines and stores a steady-state filament resistance value when said switch is in said first state and wherein said control module increases at least one of current and voltage to said filament by a first amount above said nominal level when said switch transitions to said second state based on a difference between a stored filament resistance value that is stored before said switch transitions to said second state and said stored steady state filament resistance value.

12. The control system of claim 1 further comprising:

a ballast module comprising an electrolytic capacitance element; and a first temperature sensor that senses a first temperature of said electrolytic capacitance element, wherein said control module communicates with said first temperature sensor and adjusts power output to the fluorescent light when said first temperature exceeds a predetermined threshold.

13. The control system of claim 12 wherein said control module modulates said power output based on said first temperature.

14. The control system of claim 12 further comprising a rectifier module having an input that selectively communicates with a voltage source, wherein said electrolytic capacitance element and said control module communicate with an output of said rectifier module.

15. The control system of claim 12 further comprising:

a electrical component; and a second temperature sensor that senses a second temperature of said first electrical component, wherein said control module communicates with said second temperature sensor and adjusts power output to the fluorescent light when said second temperature exceeds a predetermined threshold.

16. The control system of claim 15 further comprising a rectifier module having an input that selectively communicates with a voltage source, wherein said control module communicate with an output of said rectifier module.

17. The control system of claim 1 wherein said control module reacts based on state of said switch.

18. The control system of claim 1 wherein said switch receives power from a power source.

19. The control system of claim 1 wherein said switch is coupled between a power source and a rectifier.

20. The control system of claim 1 wherein said switch is coupled between a power source and a control module.

21. The control system of claim 1 wherein said filament is OFF when said switch is in said first state.

22. The control system of claim 1 wherein said filament receives a power signal when in an ON state and does not receive a power signal when in an OFF state.

23. A method for operating a fluorescent light, comprising:

selectively switching power to a filament of the fluorescent light between first and second states, said second state associated with supplying power to said filament and said first state associated with removing power from said filament;

sampling a filament resistance of said filament when said fluorescent light is in said first state; and selectively increasing current supplied to the fluorescent light above a nominal current value when transitioning to said second state based on said filament resistance.

24. The method of claim 23 further comprising:

determining a steady-state filament resistance value when said fluorescent light is off; and monitoring changes in said steady state filament resistance value.

25. The method of claim 24 further comprising indicating an operational state of said fluorescent light based on said filament resistance.

26. The method of claim 25 further comprising:

comparing changes in said steady state filament resistance value to a predetermined filament resistance change threshold; and changing a state of an indicator when said changes in said steady state filament resistance value exceed said predetermined filament resistance change threshold.

27. The method of claim 26 further comprising estimating ambient temperature.

28. The method of claim 27 further comprising adjusting changes in said steady state filament resistance value based on said ambient temperature.

29. The method of claim 27 further comprising estimating said ambient temperature based on a filament resistance measured after said fluorescent light has been in an off state for a predetermined period.

30. The method of claim 24 further comprising:

comparing said steady state filament resistance value to a predetermined filament resistance threshold; and changing a state of said indicator when said steady state filament resistance value exceeds said predetermined filament resistance threshold.

31. The method of claim 23 further comprising increasing at least one of current and voltage to said filament by a first amount above said nominal current level when said fluorescent light turns on based on a stored filament resistance value of said filament that is stored before said fluorescent light turns on.

32. The method of claim 31 further comprising determining and storing a steady-state filament resistance value when said fluorescent light is off and wherein said control module increases at least one of current and voltage to said filament by a first amount above said nominal level when said fluorescent light is turned on based on a difference between a stored filament resistance value that is stored before said switch turns on and said stored steady state filament resistance value.

33. The method of claim 23 further comprising:

sensing a temperature of an electrolytic capacitance element; and adjusting power output to the fluorescent light when said sensed temperature exceeds a predetermined threshold.

34. The method of claim 33 further comprising modulating said power output based on said sensed temperature.

35. The method of claim 23 further comprising:

sensing a temperature of a first electrical component; and adjusting power output to the fluorescent light when said sensed temperature exceeds a predetermined threshold.

36. A control system comprising:

lighting means having an ON state and an OFF state;

and control means that communicates with said lighting means for sampling a filament resistance of said lighting means when said lighting means is in said OFF state and for selectively increasing current supplied to said lighting means above a nominal current value when said lighting means transitions to said ON state based on said filament resistance, wherein said control means determines a steady-state filament resistance value when said switch means is in said OFF state and monitors changes in said steady state filament resistance value.

37. The control system of claim 36 further comprising Indicating means that communicates with said control means for indicating an operational state of said fluorescent light.

38. The control system of claim 37 wherein said control means compares changes in said steady state filament resistance value to a predetermined filament resistance change threshold and changes a state of said indicating means when said changes in said steady state filament resistance value exceed said predetermined filament resistance change threshold.

39. The control system of claim 37 wherein said control means compares said steady state filament resistance value to a predetermined filament resistance threshold and changes a state of said indicating means when said steady state filament resistance value exceeds said predetermined filament resistance threshold.

40. The control system of claim 37 further comprising ambient temperature estimating means for estimating ambient temperature.

41. The control system of claim 40 wherein said changes in said steady state filament resistance value are adjusted based on said ambient temperature.

42. The control system of claim 40 wherein said ambient temperature estimating means includes temperature sensing means for sensing temperature.

43. The control system of claim 40 wherein said ambient temperature estimating means estimates said ambient temperature based on a filament resistance measured after said fluorescent light has been in said OFF state for a predetermined period.

44. The control system of claim 36 further comprising switch means for switching, wherein said control means increases at least one of current and voltage to said filament by a first amount above said nominal current level when said switch means transitions to an ON state based on a stored filament resistance value of said filament that is stored before said switch means transitions to said ON state.

45. The control system of claim 44 wherein said control means determines and stores a steady-state filament resistance value when said switch means is in an OFF state and wherein said control means increases at least one of current and voltage to said filament by a first amount above said nominal level when said switch means transitions to said ON state based on a difference between a stored filament resistance value that is stored before said switch means transitions to said ON state and said stored steady state filament resistance value.

46. The control system of claim 36 further comprising:

electrolytic capacitance means for providing capacitance;

first temperature sensing means for sensing a first temperature of said electrolytic capacitance means, wherein said control means communicates with said first temperature sensing means and adjusts power output to the fluorescent light when said first temperature exceeds a predetermined threshold.

47. The control system of claim 46 wherein said control means modulates said power output based on said first temperature.

48. The control system of claim 46 further comprising rectifier means for rectifying and having an input that selectively communicates with a voltage source, wherein said electrolytic capacitance means and said control means communicate with an output of said rectifier means.

49. The control system of claim 46 further comprising:

a electrical component; and second temperature sensing means for sensing a second temperature of said electrical component, wherein said control means communicates with said second temperature sensing means and adjusts power output to the fluorescent light when said second temperature exceeds a predetermined threshold.

50. The control system of claim 49 further comprising rectifier means for rectifying and having an input that selectively communicates with a voltage source, wherein said control means communicates with an output of said rectifier means.

51. A control system comprising:

a switch that enables activation of a fluorescent light;

a temperature sensor that generates a temperature signal; and a control module that samples a filament resistance of said fluorescent light when said switch is in a first state, that selectively increases current supplied to the fluorescent light above a nominal current value when said switch transitions to a second state, and that adjusts current supplied to said filament based on said filament resistance and said temperature signal.

* * * * *

UNITED STATES PATENT AND TRADEMARK OFFICE

CERTIFICATE OF CORRECTION

PATENT NO. : 7,414,369 B2
APPLICATION NO. : 11/190025
DATED : August 19, 2008
INVENTOR(S) : Sehat Sutardja It is certified that error appears in the above-identified patent and that said Letters Patent is hereby corrected as shown below:

| | |
|---|---|
| Title Page, Item (56) | Under Foreign Patent Documents, delete "EP1338874A" since it is a duplicate |
| Title Page, Item (56)<br>Page 2, Line 1 | Under Foreign Patent Documents, delete "WO88/01467A" since it is a duplicate |
| Title Page, Item (56)<br>Page 2, Line 10-12 | Under Other Publications delete "Official Action…" since it is a duplicate |
| Column 10, Line 41 | Delete "Indicating" and insert -- indicating -- |

Signed and Sealed this

Twenty-fourth Day of February, 2009

John Doll

JOHN DOLL
*Acting Director of the United States Patent and Trademark Office*